US010487281B2

(12) United States Patent
Ruiz

(10) Patent No.: US 10,487,281 B2
(45) Date of Patent: Nov. 26, 2019

(54) METHOD FOR PREVENTION OF BIODETERIORATION OF FUELS

(71) Applicant: Government of the United States as Represented by the Secretary of the Air Force, Wright-Patterson AFB, OH (US)

(72) Inventor: Oscar N. Ruiz, Bellbrook, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 15/609,988

(22) Filed: May 31, 2017

(65) Prior Publication Data

US 2017/0260467 A1 Sep. 14, 2017

Related U.S. Application Data

(63) Continuation of application No. 14/195,151, filed on Mar. 3, 2014.

(60) Provisional application No. 61/829,593, filed on May 31, 2013.

(51) Int. Cl.
*C10L 1/14* (2006.01)
*C10L 1/238* (2006.01)

(52) U.S. Cl.
CPC ..... *C10L 1/14* (2013.01); *C10L 1/238* (2013.01); *C10L 2230/083* (2013.01)

(58) Field of Classification Search
CPC ..... C10L 1/14; C10L 1/238; C10L 2230/083
See application file for complete search history.

(56) References Cited

U.S. PATENT DOCUMENTS 2,975,042 A * 3/1961 Summers, Jr. ..... C10L 1/14 44/422
2,975,043 A * 3/1961 Ambrose ..... C10G 31/08 44/450
3,226,211 A * 12/1965 Deffner ..... C10L 1/191 44/389
3,291,580 A * 12/1966 Malick ..... C10L 1/18 44/445
5,856,127 A * 1/1999 Powell ..... C07K 7/08 435/418
2010/0316643 A1* 12/2010 Eckert ..... A01N 37/46 424/134.1

OTHER PUBLICATIONS

Sigma Aldrich. "Solubility Guidelines for Peptides" 2009 (Year: 2009).*
United States Patent and Trademark Office, Final Office Action in U.S. Appl. No. 14/195,151, dated Jul. 29, 2019, 10 pages total.

* cited by examiner

*Primary Examiner* — Latosha Hines
(74) *Attorney, Agent, or Firm* — AFMCLC/JAZ; Chastity Whitaker

(57) ABSTRACT

A method for preventing biodeterioration of fuel. The method reduces the microbial growth in fuel by administering an antimicrobial peptide (or efflux pump inhibitor) to a fuel phase of the fuel, an aqueous phase of the fuel, or both, which disrupts the cellular membrane (or the efflux pumps thereof) of microbes comprising the growth.

5 Claims, 13 Drawing Sheets

METHOD FOR PREVENTION OF BIODETERIORATION OF FUELS

This application claims the benefit of and priority to prior filed co-pending Non-Provisional Application Ser. No. 14/195,151, filed Mar. 3, 2014, which claims the benefit of and priority to prior filed, Provisional Application Ser. No. 61/829,593, filed May 31, 2013. The disclosure of each application is expressly incorporated herein by reference, in its entirety.

RIGHTS OF THE GOVERNMENT

The invention described herein may be manufactured and used by or for the Government of the United States for all governmental purposes without the payment of any royalty.

FIELD OF THE INVENTION

The present invention relates generally to antimicrobials and, more specifically, to methods of controlling microbial growth and proliferation.

BACKGROUND OF THE INVENTION

Microorganisms are highly adaptable to surrounding environments, which allows cultures to colonize nearly any environment. Some microorganism cultures are resistant to very recalcitrant pollutants including, for example, polychlorinated biphenyls, heavy metals, and hydrocarbon fuels.

Bacteria have been isolated from fuels, fuel storage tanks, pipelines, aircraft wing tanks, and offshore oil platforms, in which the bacteria may cause problems such as tank corrosion, fuel pump failures, filter plugging, injector fouling, topcoat peeling, engine damage, and deterioration of fuel chemical properties and quality. Extensive microbial growth and biofilm formation within the fuel, fuel tanks, or fuel lines may also lead to costly and disruptive damage to fuel systems. These besides have the ability to metabolize hydrocarbons and thrive in the environments containing toxic compounds (i.e., aromatic hydrocarbons), low nutrient availability (metal ions, phosphorus, etc.), and low water amounts.

Normally, bacteria metabolize alkanes via oxidation. However, the genome of bacteria adapted to grow in in jet-fuel systems and petroleum oil field (such as *P. aeruginosa*) encodes two membranes bound alkane hydroxylases (alkB1 and alkB2), essential electron transfer proteins, ruberdoxins (RubA1, RubA2), and FAD dependent NAD(P) H2 ruberdoxin reductases, which oxidize a terminal methyl group of the alkanes into a primary alcohol group via alkane hydroxylases aided with electron transfer proteins. The primary alcohol group is oxidized to an aldehyde and a fatty acid and followed by β-oxidation to generate acetyl-CoA, the entry molecule for the citric acid cycle.

The role of membrane proteins and cell membrane is crucial in regulating cell homeostasis. One class of membrane proteins, encoded by the opr genes, includes substrate specific porins that transport molecules from the extracellular environment into the cell. Two such porins, OprF and OprG, are involved in the transport of aromatic hydrocarbons and other hydrophobic small molecules into the cells. Fuel contains aromatic and cyclic hydrocarbons, which are toxic to the cell. Also, fuel can capture heavy metals and other molecules during transport and storage, which may also affect bacteria. It has been proposed that membrane proton antiporter-pumps or efflux pumps of the resistance-nodulation-division ("RND") family function in the extrusion of toxic compounds including antimicrobials, organic solvents, and heavy metals.

Despite the current understanding of bacterial growth in fuels, there remains a need for methods of controlling and/or preventing such bacterial growth and other microbes that are responsible for biodeterioration of the fuel.

SUMMARY OF THE INVENTION

The present invention overcomes the foregoing problems and other shortcomings, drawbacks, and challenges of controlling or preventing microbial biodeterioration of fuel. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a method of preventing biodeterioration of a fuel by reducing a microbial growth in the fuel includes administering an antimicrobial peptide to a fuel phase of the fuel, an aqueous phase of the fuel, or both. The antimicrobial peptide is configured to disrupt cellular membranes of the microbes compromising the growth and includes antimicrobial peptides having a β-sheet conformation, an α-helix conformation, or a combination thereof.

In accordance with another embodiment of the present invention, a method of preventing biodeterioration of a fuel by reducing a microbial growth in the fuel includes administering an efflux pump inhibitor to a fuel phase of the fuel, an aqueous phase of the fuel, or both. The efflux pump inhibitor is configured to block an efflux transport of toxins by efflux pumps or porins from microbes comprising the growth. The efflux pump inhibitor is selected from a group consisting of peptidomimetic, a c-capped dipeptide, an antibody, a nanobody, and nucleic acid, an aptamer, a peptide with second, tertiary, or quaternary structure configured to block efflux pumps or porins, and a small chemical molecule configured to block efflux pumps or porins.

Yet another embodiment of the present invention is directed to an antimicrobial fuel comprising a fuel phase and an aqueous phase at least partially separated from the fuel phase. An effective concentration of an antimicrobial peptide is in the fuel phase, the aqueous phase, or both, and is configured to disrupt a cellular membrane of microbes within the fuel.

Still another embodiment of the present invention is directed to an antimicrobial fuel comprising a fuel phase and an aqueous phase at least partially separated from the fuel phase. An effective concentration of an efflux pump inhibitor is in the fuel phase, the aqueous phase, or both, and is configured to block an efflux transport of toxins by at least one efflux pump of microbes in the fuel.

According to another embodiment of the present invention, a fuel treatment solution includes a lyophilized antimicrobial peptide, a lyophilized efflux pump inhibitor, or both dissolved in an amphipathic solvent.

According to one aspect of the present invention, the fuel treatment solution may be administered to a fuel phase of a fuel. The fuel treatment solution migrates from the fuel phase to an aqueous phase and inhibits microbial growth.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
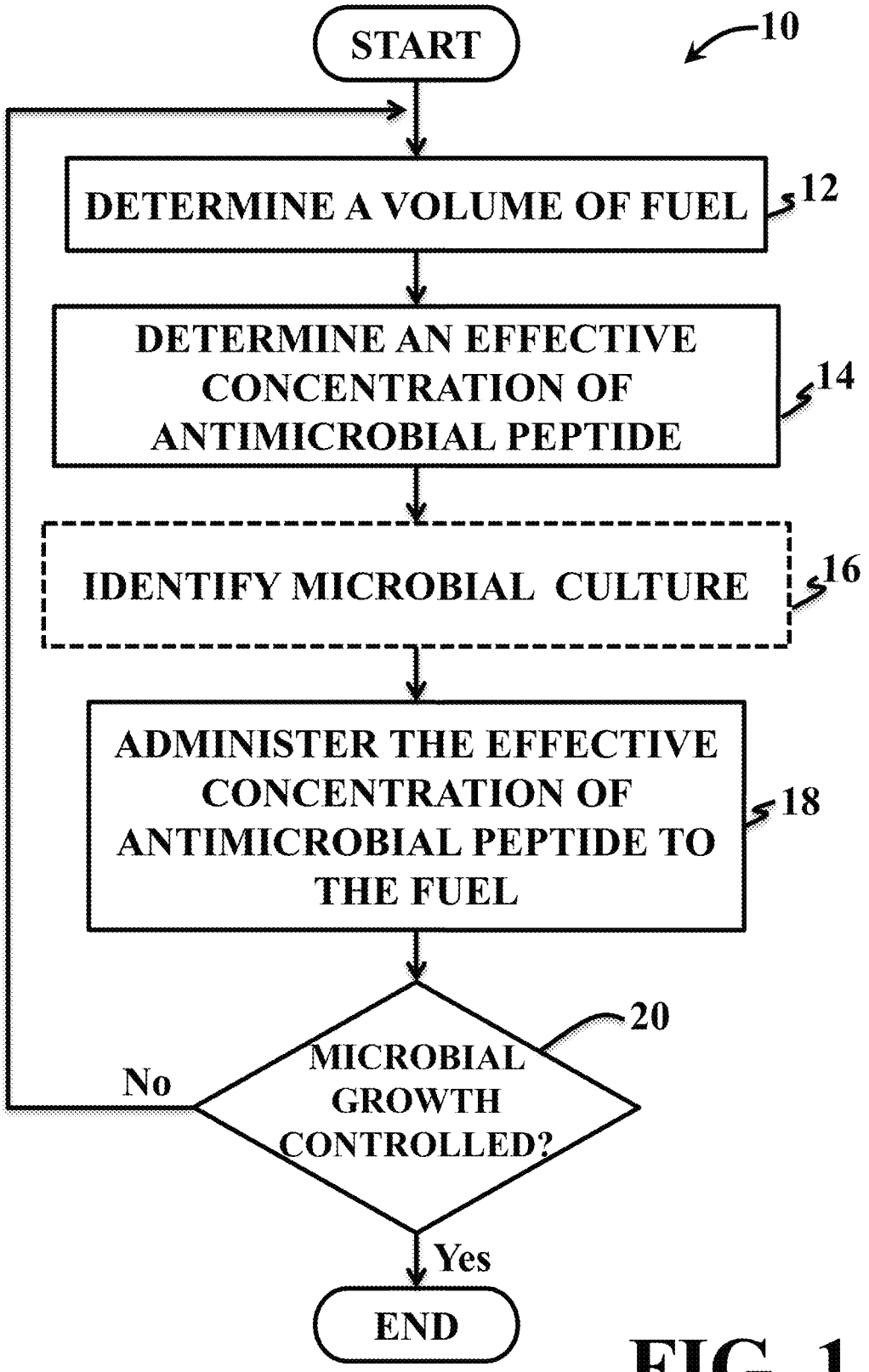
FIG. 1 is a flowchart illustrating an exemplary method of preventing the biodeterioration of fuel with antimicrobial peptides, in accordance with one embodiment of the present invention.

Turning now to the figures, and in particular to FIG. 1, a flowchart 10 illustrating a method of inhibiting bacterial growth in fuel according to one embodiment of the present invention is shown. In block 12, a container of fuel is accessed, for example, a fuel tanker, and a volume of fuel therein is determined. Determination of the volume of the fuel is necessary so that an effective concentration of an antimicrobial peptide may be added thereto and as described in greater detail below. The fuel may comprise a fuel phase and an aqueous phase that is at least partially separated from the fuel phase, for example, by fluid layering.

With volume of the fuel, an effective concentration of antimicrobial peptide is determined (Block 14). The effective concentration depends, in part, on a selected antimicrobial peptide, which generally includes peptides having a β-sheet conformation, an α-helix conformation, or both.

The effective concentration may also depend, in part, on an identity of the microbial culture, which may include environmental, fuel-degrading bacteria (for example, *Pseudomonas, Bacillus, Achromobacter, Marinobacter, Rhodovumlum, Dietzia, Halobacillus, Acinetobacter, Alcaligenes, Nocardioides, Rhodococcus, Methylobacterium, Loktanella, Escherichia*, and *Staphylococcus*), fungi (for example, *Yarrowia, Hormoconis*, and *Cladosporium*), or combinations thereof. In that regard, and if desired, an identity of the microbial culture may be determined (Block 16) and may include a cell count or density, for example, ranging 1 cell per mL fuel to $1\times10^9$ cells per mL fuel, although these cell densities are not limiting. Effective concentrations may range from about 1 μg/mL to about 100 μg/mL (or about 1 ppm to about 100 ppm), but is generally considered to be a minimum concentration at which the microbial culture growth decreases by 85% to 100%.

The effective concentration of the antimicrobial peptide is administered to the fuel phase, the aqueous phase, or both phases of the fuel (Block 18). After a desired time, for example, ranging from 24 hours to several days (four or more days), control of microbial growth is determined (Block 20). If microbial densities are less than 0.2 OD or $1\times10^6$ cell/mL, then microbial growth is controlled ("Yes" branch of Decision Block 20) and the process ends. However, if microbial growth is greater than 0.2 OD or $1\times10^6$ cell/mL, then microbial growth is not controlled ("No" branch of Decision Block 20) and the process returns to again determine the volume of the fuel (Block 12).

Figure 1A:
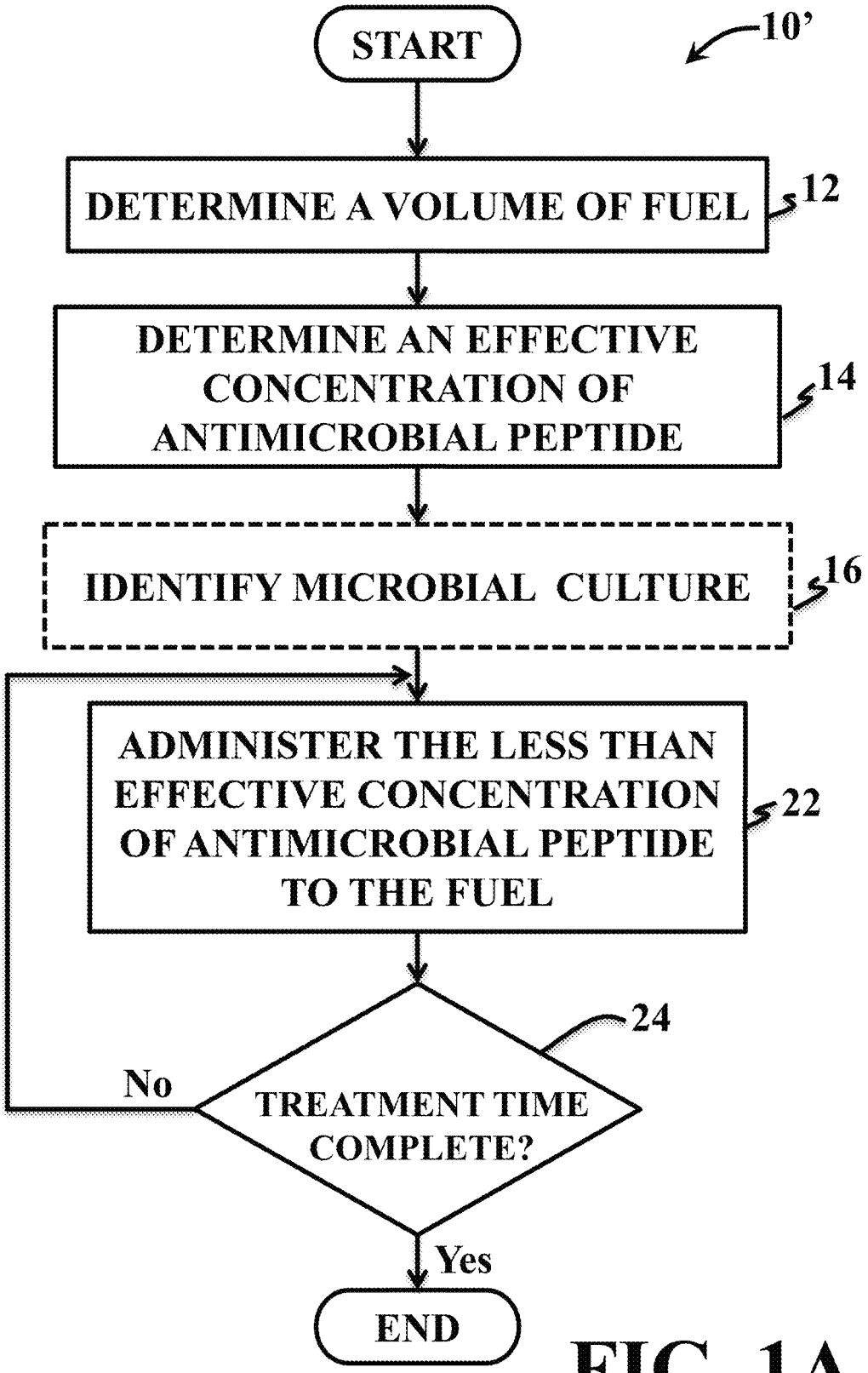
FIG. 1A is a flowchart illustrating an exemplary method of preventing the biodeterioration of fuel with antimicrobial peptides, in accordance with another embodiment of the present invention.

Alternatively, and as shown in FIG. 1A, the flowchart 10' illustrates a method in which a less than effective concentration of the antimicrobial peptide may be administered to the fuel phase, the aqueous phase, or both phases of the fuel (Block 22). The administration of this lower concentration of the antimicrobial peptide continues periodically (which may be hours, days, or weeks) ("No" branch of Decision Block 24) until a treatment time is complete ("Yes" branch of Decision Block 24), which may be, for example, 1 to 3 or 1 to 6 months.

Figure 1B:
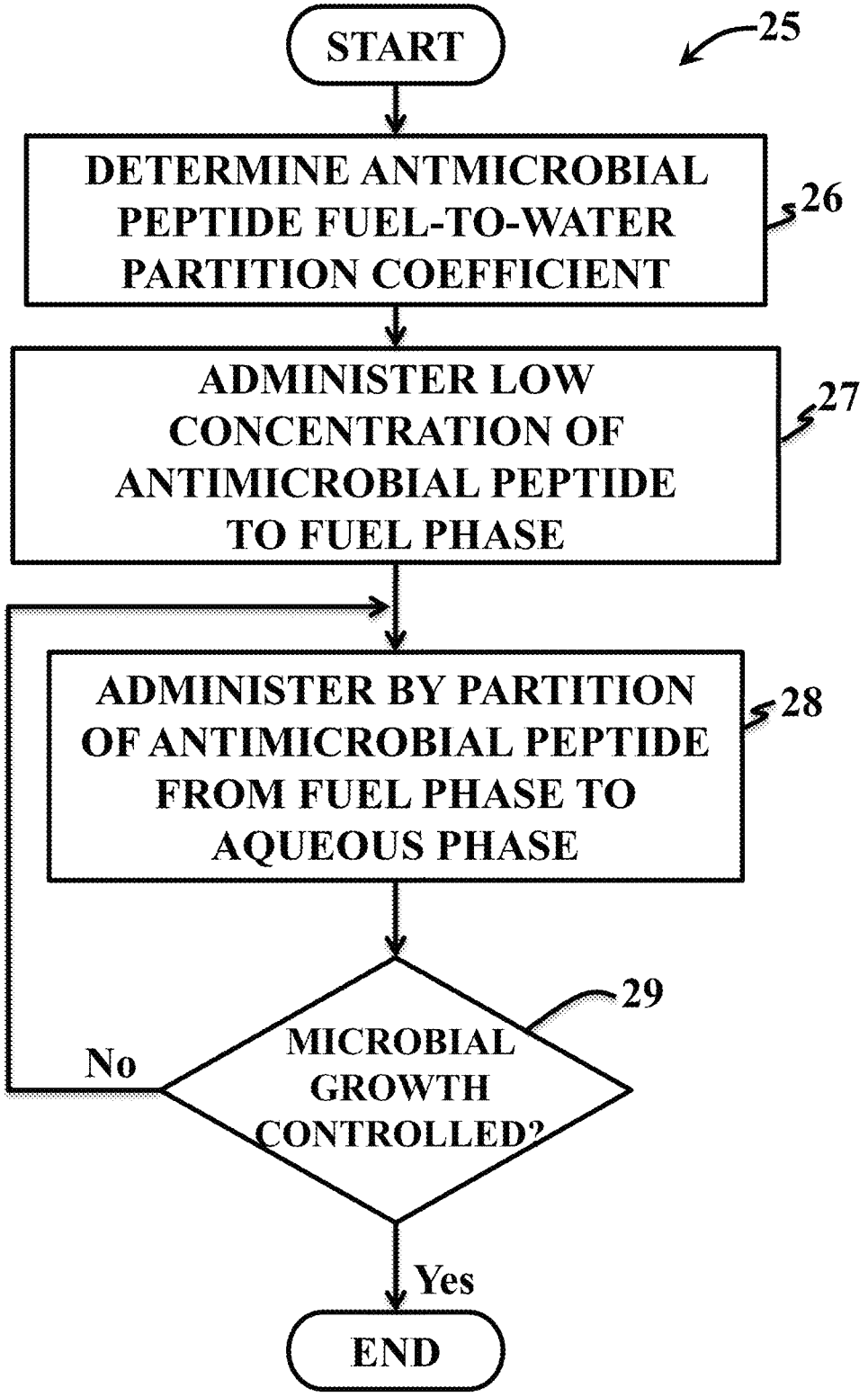
FIG. 1B is a flowchart illustrating an exemplary method of preventing the biodeterioration of fuel with antimicrobial peptides, in accordance with another embodiment of the present invention.

FIG. 1B includes a flowchart 25 illustrating a method of treating large volumes of fuel, for example, in large tanks during transport, in accordance with another embodiment of the present invention. Specifically, an antimicrobial peptide fuel-to-water partition coefficient is determined (Block 26) so that a low concentration of antimicrobial peptide may be administered to the fuel phase (Block 27). Subsequently, for example, after a few hours to several days, the antimicrobial peptide is administrated by partition of antimicrobial peptide from the fuel phase to the aqueous phase, which is proximate a bottom surface of a container in which the fuel is stored (Block 28); concentrating the antimicrobial peptide to the effective concentration in the aqueous phase. Thereafter, for example, 24 hours to several days (four or more days) microbial growth is determined as described previously. If the microbial growth is controlled ("Yes" branch of Decision Block 29), then the process ends; however, if microbial growth remains uncontrolled ("No" branch of Decision Block 29) then the process returns to further administer antimicrobial peptide to the aqueous phase (Block 28).

Antimicrobial peptides are peptides produced and utilized by animals to protect again microorganisms. Generally, antimicrobial peptides are non-discriminatory against bacteria, fungi, and viruses by interacting directly with cell membranes rather than with specific proteins within the membranes. In that regard, the antimicrobial peptides may permeate and destabilize the cell membrane, leading to cellular death. Two examples of highly active, small antimicrobial peptides include Protegrin-1 (PG-1) and Magainin-2. PG-1 is an 18 amino acid cysteine-rich β-sheet peptide while Magainin-2 is 23-residue peptide with an α-helical conformation. Each of these peptides effectively perforates cellular membranes by agglomerating into forming pores across the membrane, which lead to cell lysis.

Figure 2:
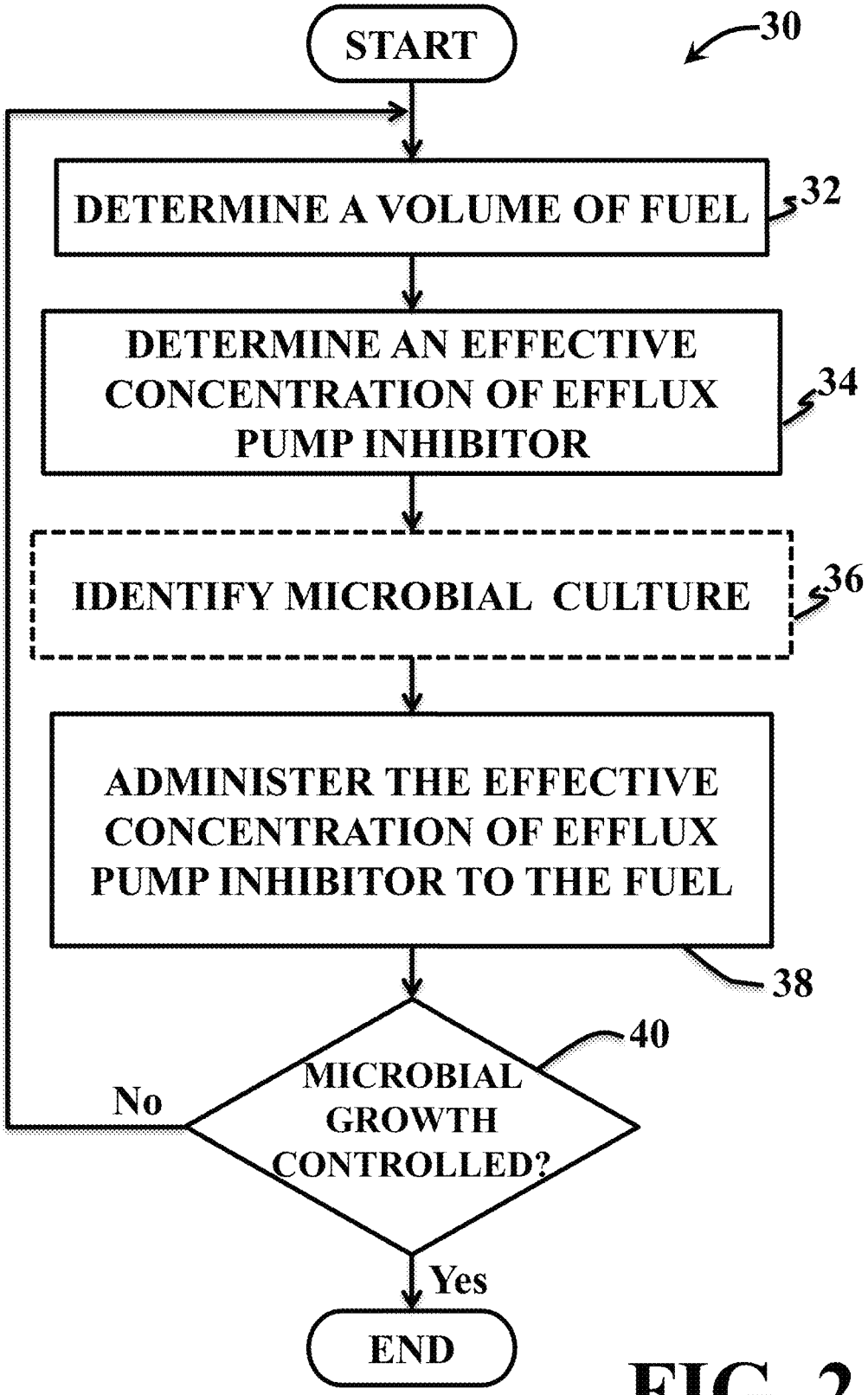
FIG. 2 is a flowchart illustrating an exemplary method of preventing the biodeterioration of fuel with efflux pump inhibitors, in accordance with one embodiment of the present invention.

Turning now to FIG. 2, a flowchart 30 illustrating a method of inhibiting bacterial growth in fuel according to another embodiment of the present invention is shown. In block 32, a container of fuel is accessed, for example, a fuel tanker, and a volume of fuel therein is determined. Determination of the volume of the fuel is necessary so that an effective concentration of an efflux pump inhibitor may be added thereto and as described in greater detail below. The fuel may comprise a fuel phase and an aqueous phase that is at least partially separated from the fuel phase, for example, by fluid layering.

With volume of the fuel, an effective concentration of efflux pump inhibitor is determined (Block 34). The effective concentration depends, in part, on a selected efflux pump inhibitor, which, for example, may include one or more of c-capped dipeptides, Phe-Arg-β-napththylamide, and MC-207,100.

The effective concentration may also depend, in part, on an identity of the microbial culture, which may include environmental, fuel degrading bacteria (for example, *Pseudomonas, Bacillus, Achromobacter, Marinobacter, Rhodovulum, Dietzia, Halobacillus, Acinetobacter, Alcaligenes, Nocardioides, Rhodococcus, Methylobacterium, Loktanella, Escherichia*, and *Staphylococcus*) or combinations thereof. In that regard, and if desired, an identity of the microbial culture may be determined (Block 36) and may include a cell count or density, for example, ranging 1 cell per mL fuel to $1\times10^9$ cells per mL fuel, although these cell densities are not limiting. Effective concentrations may range from about 20 μg/mL to about 80 μg/mL (or about 20 ppm to about 80 ppm), but is generally considered to be a minimum concentration at which the microbial culture growth decreases by 85% to 100%.

The effective concentration of the efflux pump inhibitor is administered to the fuel phase, the aqueous phase, or both phases of the fuel (Block 38). After a desired time, for example, ranging from 24 hours to several days (four or more days), control of microbial growth is determined (Block 40). If microbial densities are less than 0.2 OD or $1\times10^6$ cell/mL, then microbial growth is controlled ("Yes" branch of Decision Block 40) and the process ends. However, if microbial growth is greater than 0.2 OD or $1\times10^6$ cell/mL, then microbial growth is not controlled ("No" branch of Decision Block 40) and the process returns to again determiner the volume of the fuel (Block 32).

Efflux pumps inhibitors may include peptidomimetics, c-capped dipeptides, dipeptide compounds, Phe-Arg-β-napthylamide and analog structures, diamine-containing peptides and analogs, compounds that competitively bind to the substrate binding sites of resistance nodulation division ("RND") family of efflux pumps, compounds that competitively bind to the substrate binding sites of major facilitator superfamily ("MFS") of efflux pumps, compounds that competitively bind to the substrate binding sites of ATP-binding cassette ("ABC") superfamily of efflux pumps, allosteric inhibitors of efflux pumps, efflux pump inhibitors (such as, pyridopyrimidines, arylpiperazines, and arylpiperidines), antibodies or nanobodies raise to recognize epitopes in the efflux pumps or porins and that block efflux pump activity by binding to the efflux pump, nucleic acids, aptamers, small chemical molecules having structures configured to recognize, interact, and block efflux pumps or porins, and peptides having secondary, tertiary, or quaternary structure that is configured to bind and block efflux pumps or porins within the cellular membranes of the microbes. With the efflux pumps blocked, toxins from the fuel accumulate within the cytoplasm of the microbes and prevent microbial growth.

Figure 2A:
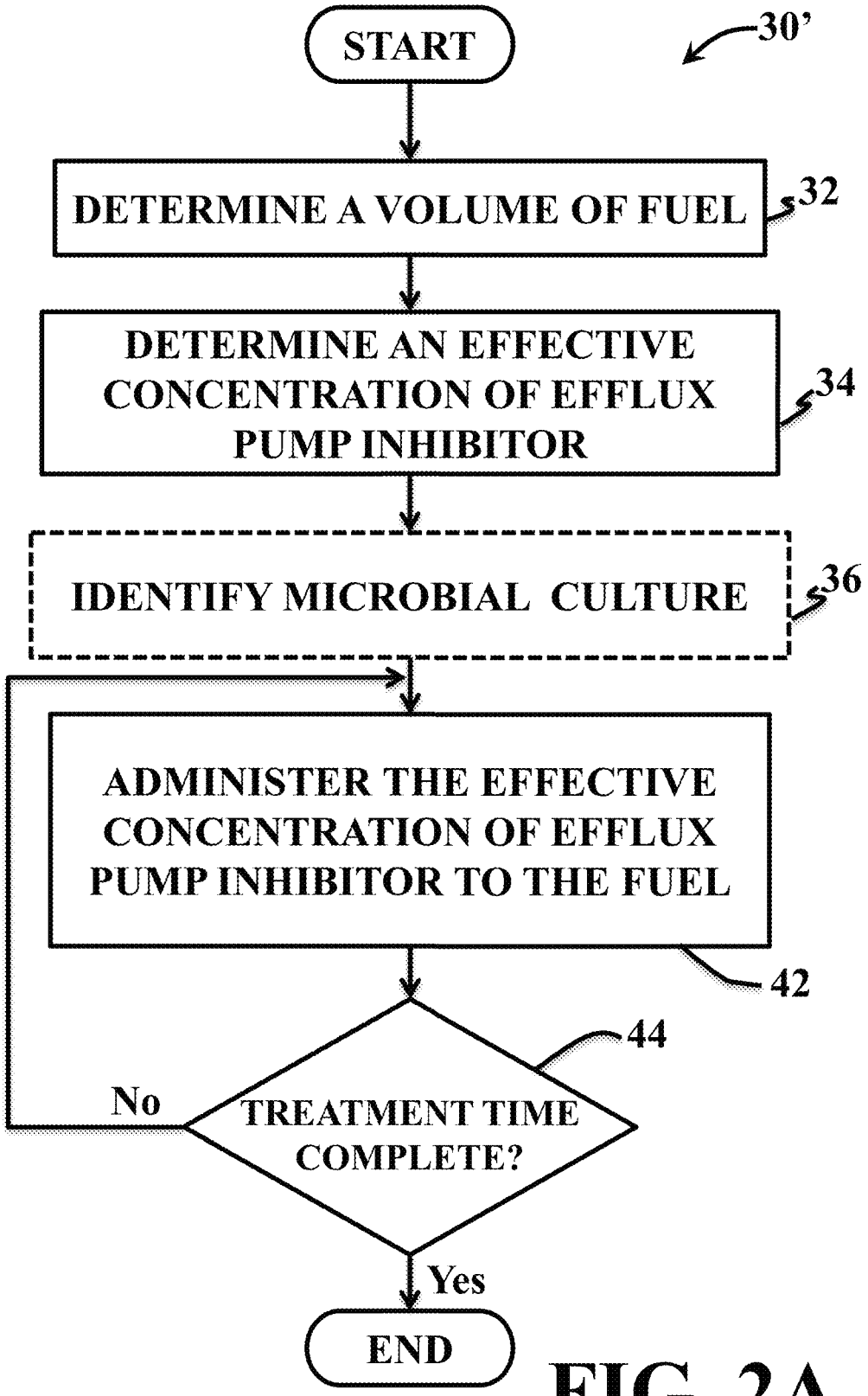
FIG. 2A is a flowchart illustrating an exemplary method of preventing the biodeterioration of fuel with efflux pump inhibitors, in accordance with another embodiment of the present invention.

Alternatively, and as shown in FIG. 2A, a less than effective concentration of the efflux pump inhibitor may be administered to the fuel phase, the aqueous phase, or both phases of the fuel (Block 42). The administration of this lower concentration of the efflux pump inhibitor continues periodically (which may be hours, days, or weeks) ("No" branch of Decision Block 44) until a treatment time is complete ("Yes" branch of Decision Block 44), which may be, for example, 1 to 3 or 1 to 6 months.

Figure 2B:
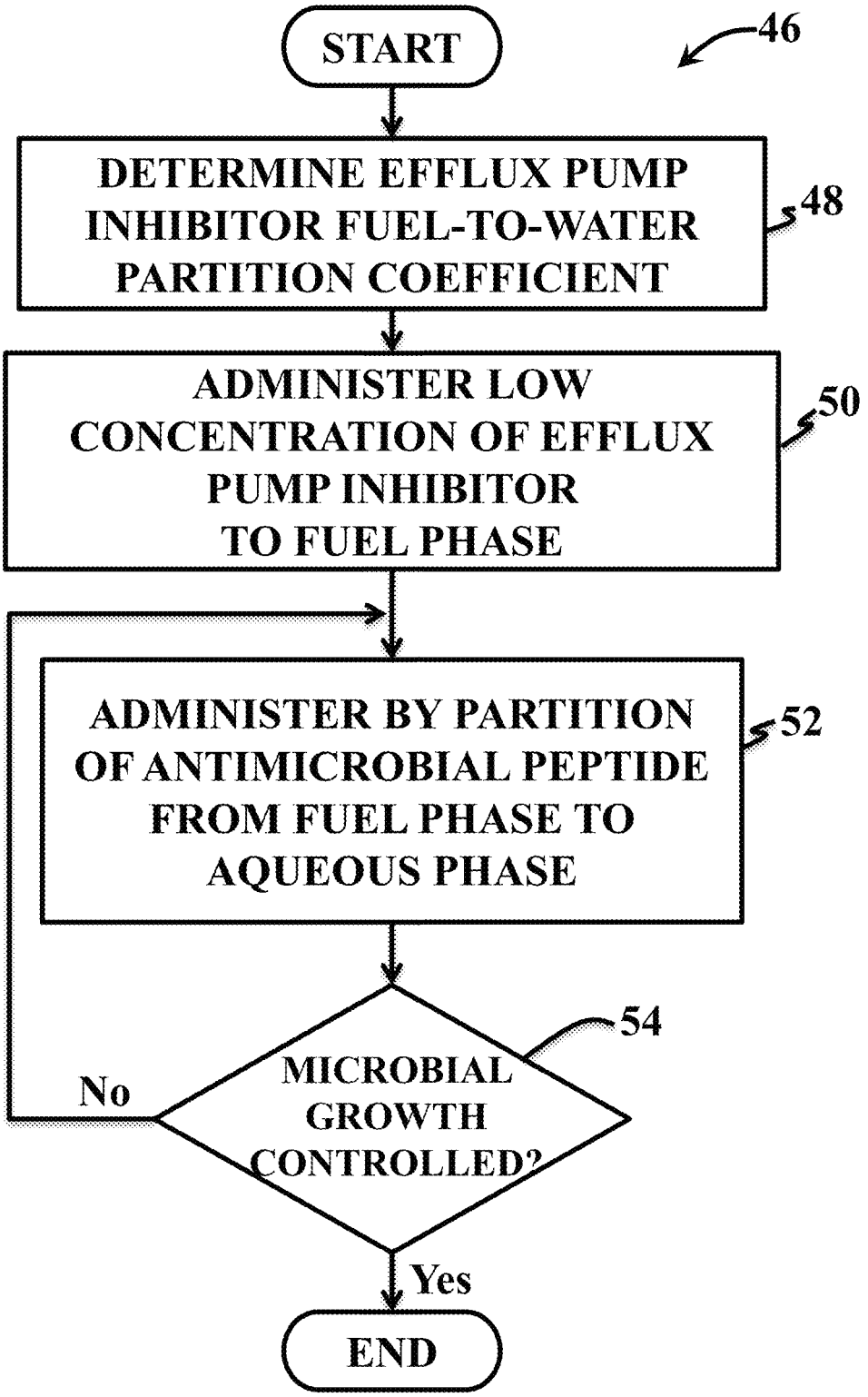
FIG. 2B is a flowchart illustrating an exemplary method of preventing the biodeterioration of fuel with efflux pump inhibitors, in accordance with another embodiment of the present invention.

FIG. 2B includes a flowchart 46 illustrating a method of treating large volumes of fuel with an efflux pump inhibitor in accordance with another embodiment of the present invention. Specifically, an efflux pump inhibitor fuel-to-water partition coefficient is determined (Block 48) so that a low concentration of the efflux pump inhibitor may be administered to the fuel phase (Block 50). Subsequently, for example, after a few hours to several days, the efflux pump blocker is administrated by partition of efflux pump blocker from the fuel phase to the aqueous phase, which is proximate a bottom surface of a container in which the fuel is stored (Block 52); concentrating the efflux pump blocker to the effective concentration in the aqueous phase. Thereafter, for example, 24 hours to several days (four or more days) microbial growth is determined as described previously. If the microbial growth is controlled ("Yes" branch of Decision Block 54), then the process ends; however, if microbial growth remains uncontrolled ("No" branch of Decision Block 54) then the process returns to further administer efflux pump inhibitor to the aqueous phase (Block 52).

Efflux pumps inhibitors are peptidomimetics, c-capped dipeptides, small peptides, antibodies, nucleic acids, aptamers, small molecules, and chemicals that are configured to bind and block efflux pumps in the cellular membranes of microbes. Once blocked, the efflux pumps are prevented from exporting accumulated toxic compounds in fuel from inside the microbe, leading to growth inhibition.

Figure 3:
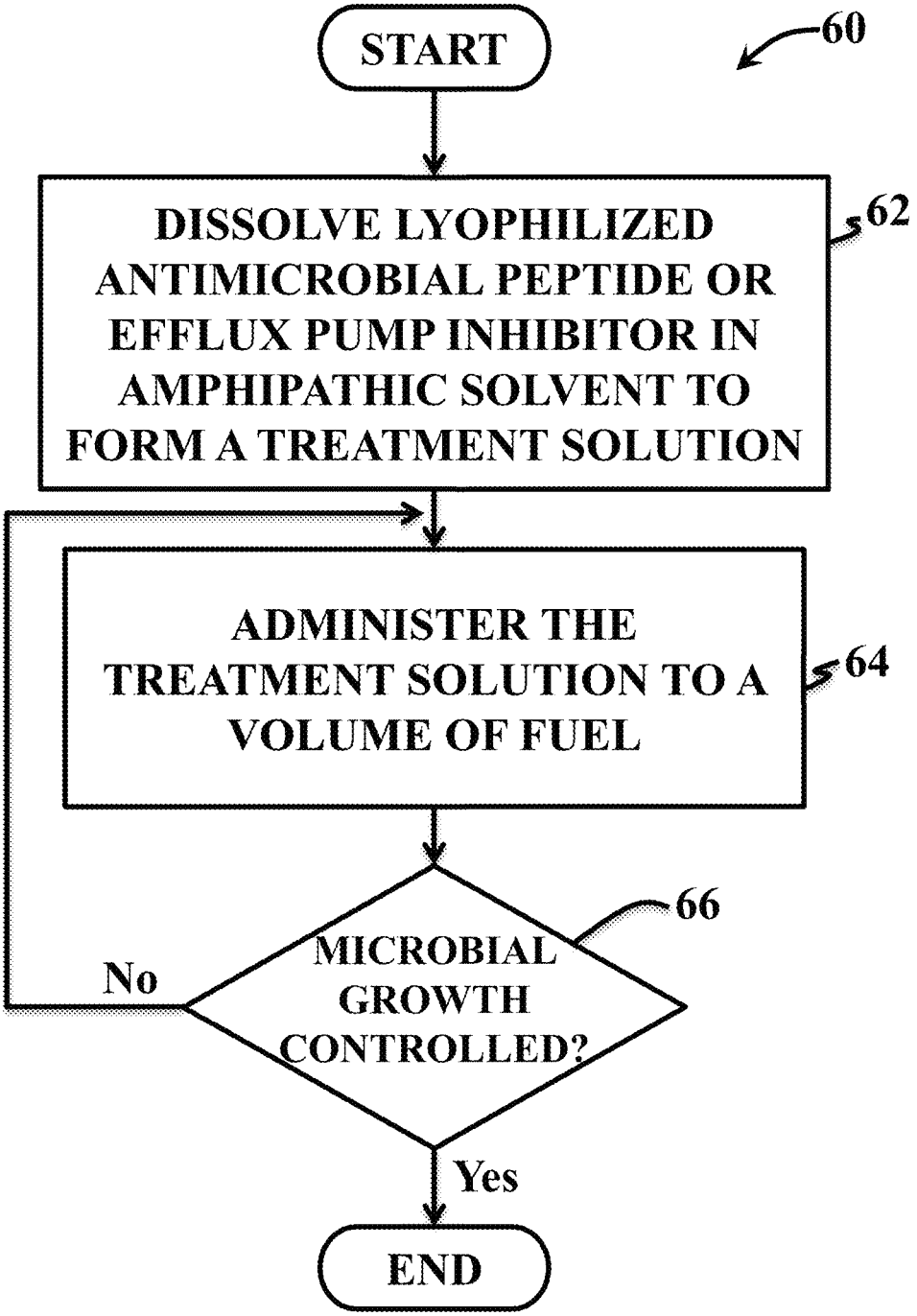
FIG. 3 is a flowchart illustrating an exemplary method of preparing a fuel treatment solution and administering the same to a fuel in accordance with one embodiment of the present invention.

With reference now to FIG. 3, a method for delivering an antimicrobial peptide or an efflux pump inhibitor to nonpolar, hydrocarbon fuel is shown in flowchart 60 and according to an embodiment of the present invention. In Block 62, an amount of lyophilized (anhydrous form) antimicrobial peptide or efflux pump inhibitor is dissolved in an amphipathic solvent. Suitable antimicrobial peptides may include protegrin-1 and magainin-2; suitable efflux pump inhibitors may include c-capped dipeptides and Phe-Arg-β-napthylamide; and suitable amphipathic solvents may include diethylene glycol monomethyl ether ("DiEGME") or absolute ethanol (200 proof or anhydrous). The mixture of antimicrobial peptide or efflux pump inhibitor in amphipathic solvent provides a concentrated stock treatment solution that mixes, seamlessly, directly with the fuel without phase separation. Because of the high water partition coefficient of the amphipathic solvent and the antimicrobial, the treatment solution may migrate from the fuel phase to the aqueous phase of the fuel, the latter of which being a preferred growth environment of microbes. Resultantly, large volumes of fuel, stored for long term use or transport, may be treated without directly accessing the aqueous phase.

Accordingly, and as provided in Block 64, the treatment solution may be administrated to the volume of fuel.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention. Thereafter, for example, 24 hours to several days (four or more days) microbial growth is determined as described previously. If the microbial growth is controlled ("Yes" branch of Decision Block 66), then the process ends; however, if microbial growth remains uncontrolled ("No" branch of Decision Block 66) then the process returns to further administer the treatment solution to the volume of fuel (Block 64).

Example 1

Protegrin-1 and Magainin-2 antimicrobial peptides were added individually to the fuel phase and the aqueous (minimal media M9, Bushnell-Haas, or water) phase of 1:1 fuel-growth media mixtures containing environmental bacteria (*E. coli, Bacillus*, and *Pseudomonas*) at concentrations ranging from 1 to $1\times10^9$ cells/mL. Magainin 1 and 2 were obtained from Sigma-Aldrich (St. Louis, Mo.). Protegrin-1 was obtained from AnaSpec (Fremont, Calif.) or produced from a transgenic construct containing a fusion between green fluorescent protein ("GFP") and the Protegrin-1 coding gene. The GFP-Protegrin fusion was purified by affinity chromatography and Protegrin cleaved from the fusion for use, as pure, or as a fusion in the bioassays.

The antimicrobial peptides were added at the following concentrations: 0 μg/mL, 1 μg/mL, 2.5 μg/mL, 5 μg/mL, 10 μg/mL, 20 μg/mL, 50 μg/mL, 75 μg/mL, 100 μg/mL, and 125 μg/mL in the presence and absence of fuel. Experiments using minimal media with bacteria in the presence of fuel were designed to measure the effect of fuel in combination with the antimicrobial peptide control. Control experiments contained glycerol instead of fuel as the energy source.

Addition of the antimicrobial peptides directly to the fuel phase lowered the amount of peptide required to achieve complete growth inhibition by at least two-fold. Protegrin-1 showed activity that prevented microbial growth at concentrations less than or equal to about 1 μg/mL.

The antimicrobial effect of the peptides was measured every 24 hours for four days after inoculation by measuring growth through absorbance readings (OD600), DNA quantitation through qPCR, and colony counting techniques.

Figure 4:
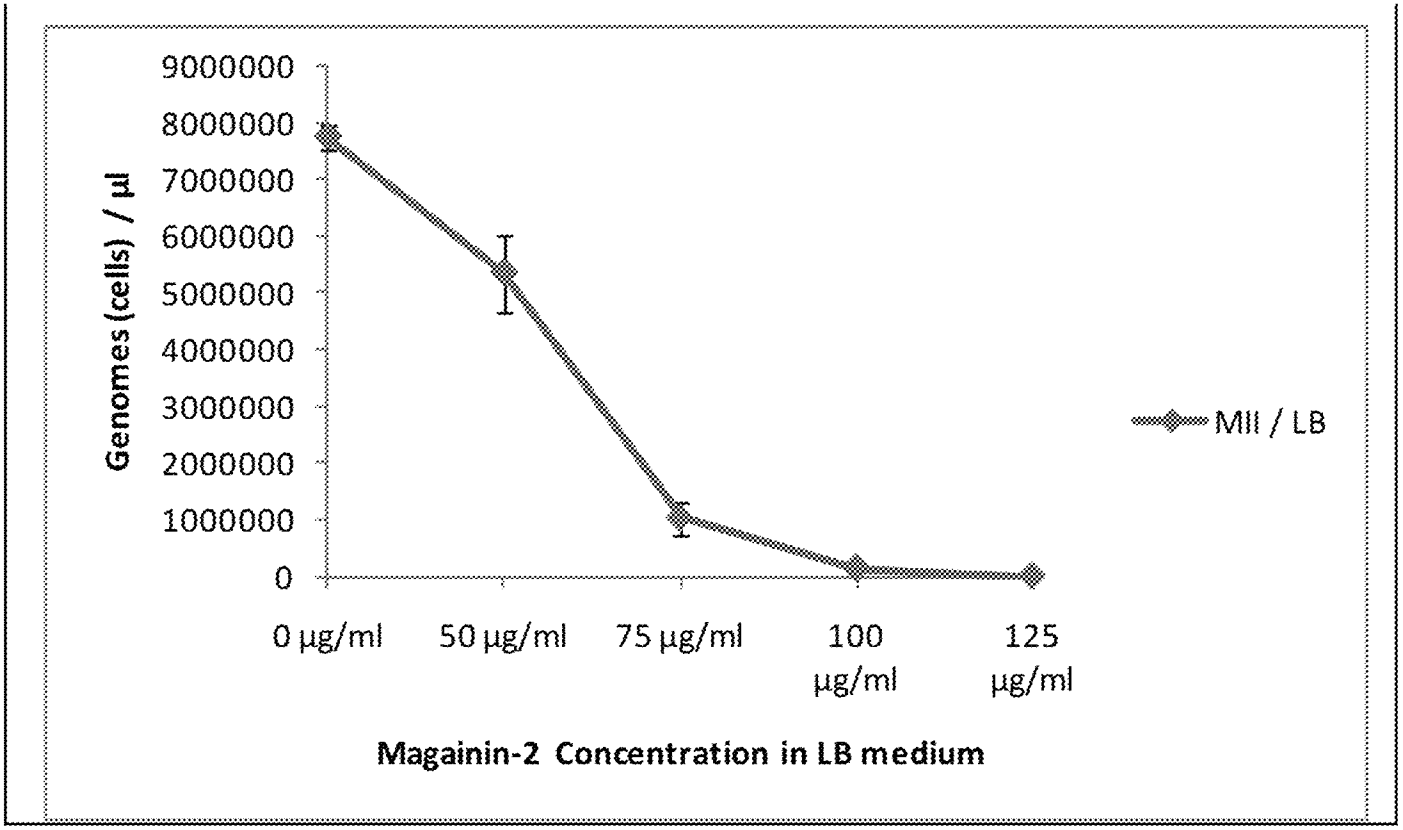
FIGS. 4-12 are graphical representations of data acquired in the use of antimicrobial peptides, efflux pump inhibitors, or both in preventing the biodeterioration of fuel.
Figure 5:
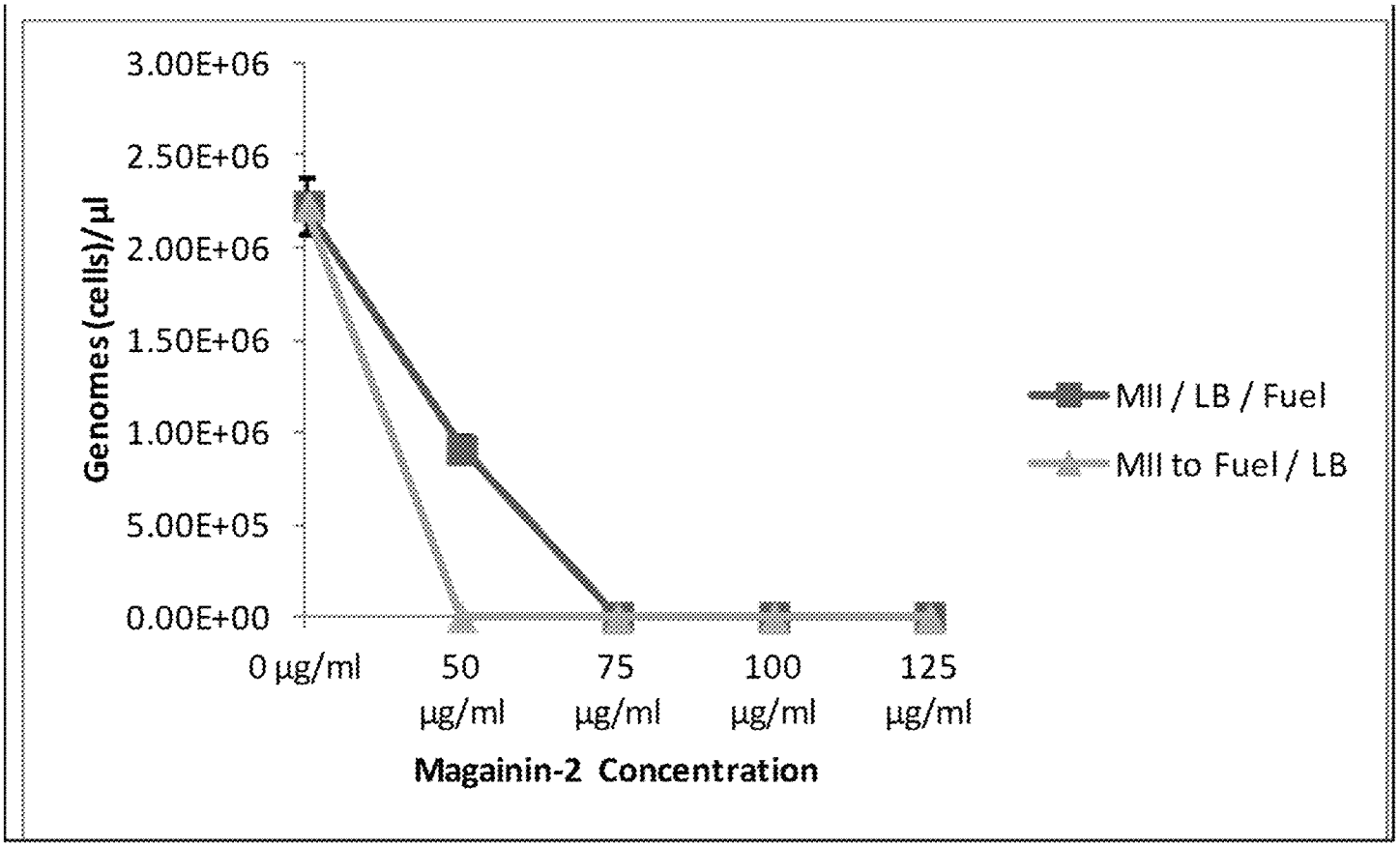

The addition of antimicrobial peptides of the type Protegrin-1 and Magainin-2 to fuel (aqueous and fuel phase) partitioned into the aqueous phase and inhibited bacteria growth. FIGS. 4 and 5 demonstrate the effect on bacterial growth (density of bacterial cells) with peptide (here, Magainin-2) concentration. While a concentration of 125 μg/mL Magainin-2 was required to completely inhibit bacteria growth in the absence of fuel (FIG. 4), only 50 μg/mL to 75 μg/mL concentrations of Magainin-2 was required in the presence of fuel (FIG. 5).

Figure 6:
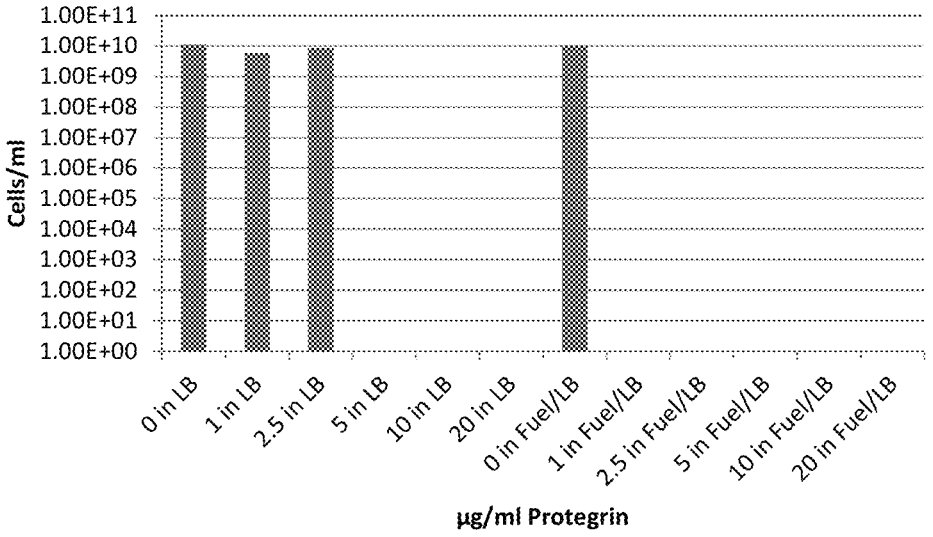
Figure 7:
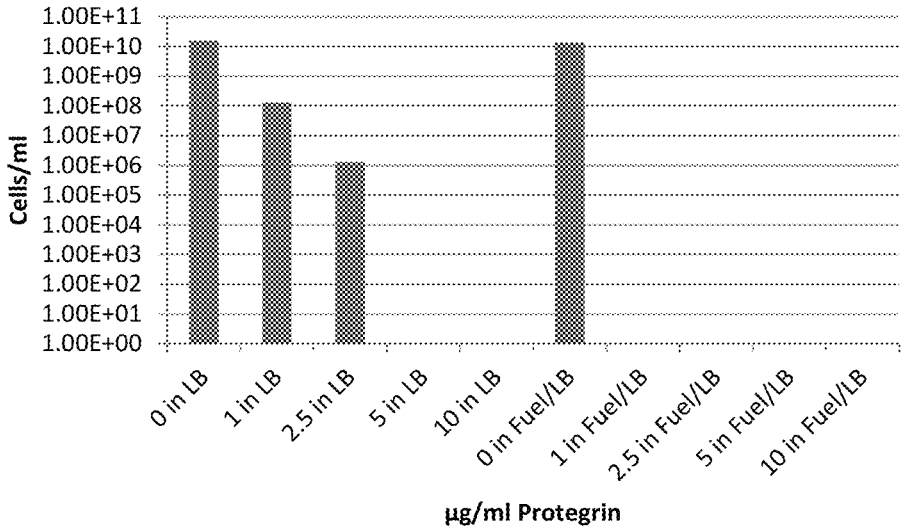

FIGS. 6 and 7 demonstrates the effect on microbial growth (density of *E. coli* and is shown) with peptide (here, Protegrin-1) concentration. In the presence of fuel, concentrations of Protegrin-1 was reduced to less than about 1 μg/mL to inhibit the growth of *E. coli* (FIG. 6) and *Pseudomonas* (FIG. 7) as compared to 5 μg/mL for growths in the absence of fuel.

When the antimicrobial peptide Protegrin-1 was used in the presence of fuel, the concentration required to completely inhibit growth was reduced from 5 μg/mL in *E. coli* and *Pseudomonas* to less than or equal to 1 μg/mL (FIGS. 6 and 7). Addition of the antimicrobial peptides directly to fuel lower the amount of peptide required to achieve complete growth inhibition by at least two-fold.

Example 2

C-capped dipeptide efflux pump blocker, Phe-Arg β-naphthylamide dihydrochloride (MC-207,110) (Sigma Aldrich) was added to the fuel phase and the aqueous (minimal media M9, Bushnell-Haas, or water) phase of 1:1 fuel-minimal media mixtures containing environmental bacteria (*Pseudomonas, Acinetobacter*, Marinobacter, and Dietzia) at concentrations ranging from 1 to $1\times10^9$ cells/mL. Phe-Arg β-naphthylamide dihydrochloride was added to the fuel at concentrations of 0 μg/mL, 20 μg/mL, 40 μg/mL, 60 μg/mL, 80 μg/mL, and 100 μg/mL. Control experiments were performed by adding 0 μg/mL to 120 μg/mL of Phe-Arg β-naphthylamide to minimal media containing bacteria and glycerol as the energy source, but not fuel.

Figure 8:
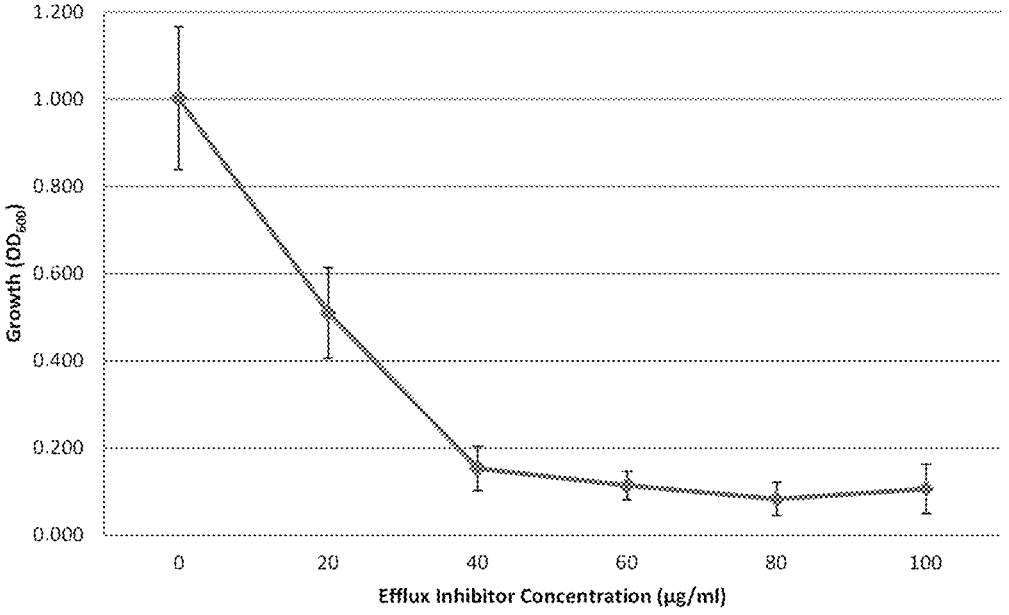
Figure 9:
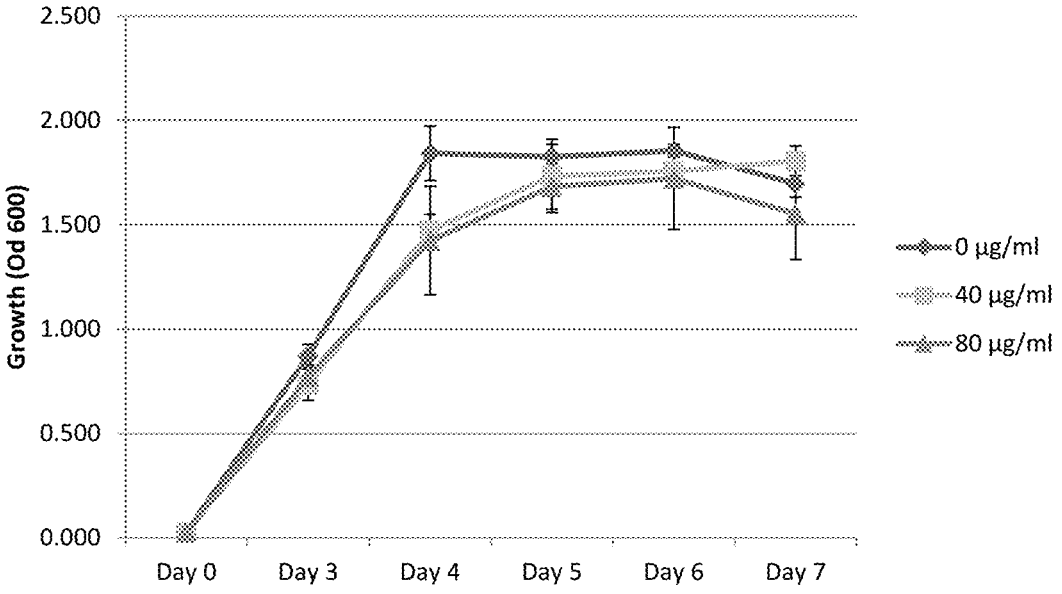
Figure 10:
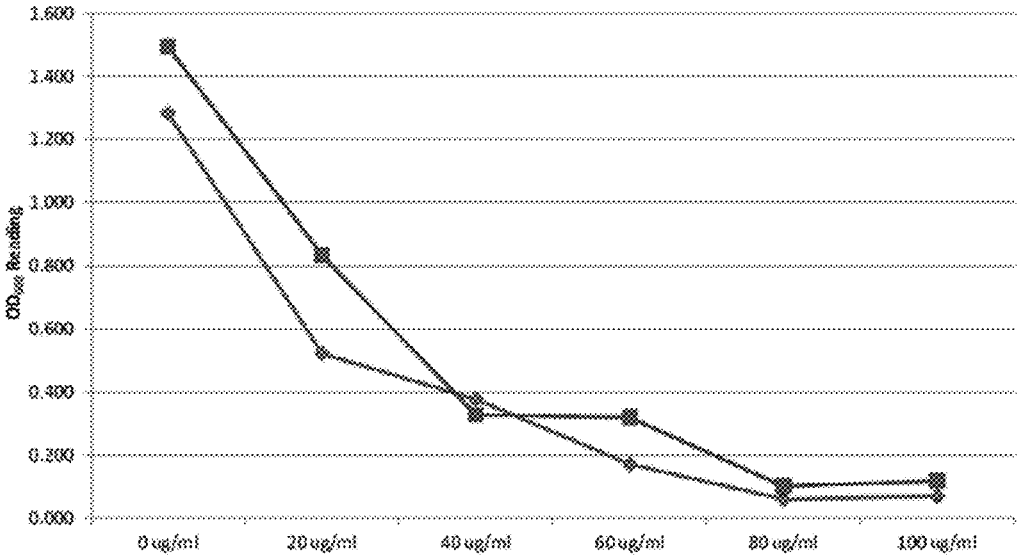

Partial bacterial growth inhibition was observed at 20 μg/mL and complete growth inhibition was achieved at 40 μg/mL, 60 μg/mL, 80 μg/mL, and 100 μg/mL of c-capped dipeptide, as shown in FIGS. 8 and 10. As demonstrated in FIG. 9, the inhibitory effect was not observed when fuel was not present, even when c-capped dipeptide concentrations as high as 100 μg/mL, which would indicate (1) that the c-capped dipeptide does not present a direct, toxic effect to the bacteria and (2) that the growth inhibition effect was due to the toxicity of fuel accumulation within the bacteria. Additional experimental results (see FIG. 10) confirm that the growth inhibition effect and the inactivity of efflux pump were effective for other bacteria, including *Pseudomonas aeruginosa* and *Acinetobacter venetianus*. The c-capped dipeptides were stable in the presence of fuel and activity was preserved.

Figure 11:
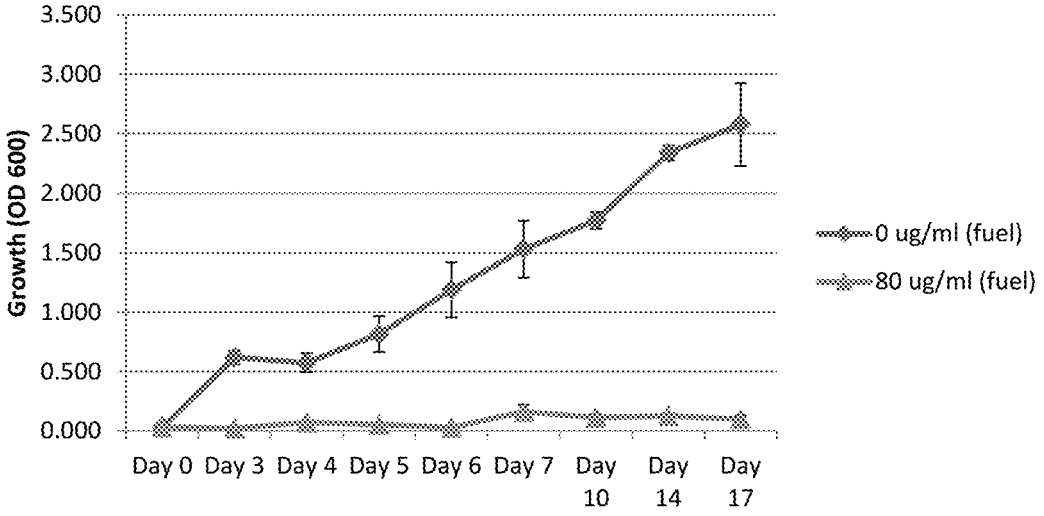

The effective concentration to produce complete growth inhibition ranged from 20 μg/mL to 80 μg/mL and was dependent on the bacterial level and the length of the incubation used. Complete growth inhibition for up to 17 days was observed at concentrations greater than about 80 μg/mL (FIG. 11). Periodic administration of a low concentration (i.e., less than the effective concentration, for example, less than 20 μg/mL) of the efflux pump blocker at regular intervals (every 3 to 4 days) prevented microbial growth and proliferation. The antimicrobial effect of the efflux pump blocker was established daily by measuring growth through absorbance readings (OD600), DNA quantitation through qPCR, and colony counting techniques.

Example 3

Treatment solutions were prepared, as described above, with 25 mg/mL efflux pump inhibitor in various solvents, including absolute ethanol, DiEGME, and water. The treatment solutions were administrated to jet fuel at a final concentration in fuel of 0 μg/mL, 40 μg/mL, and 80 μg/mL.

Figure 12:
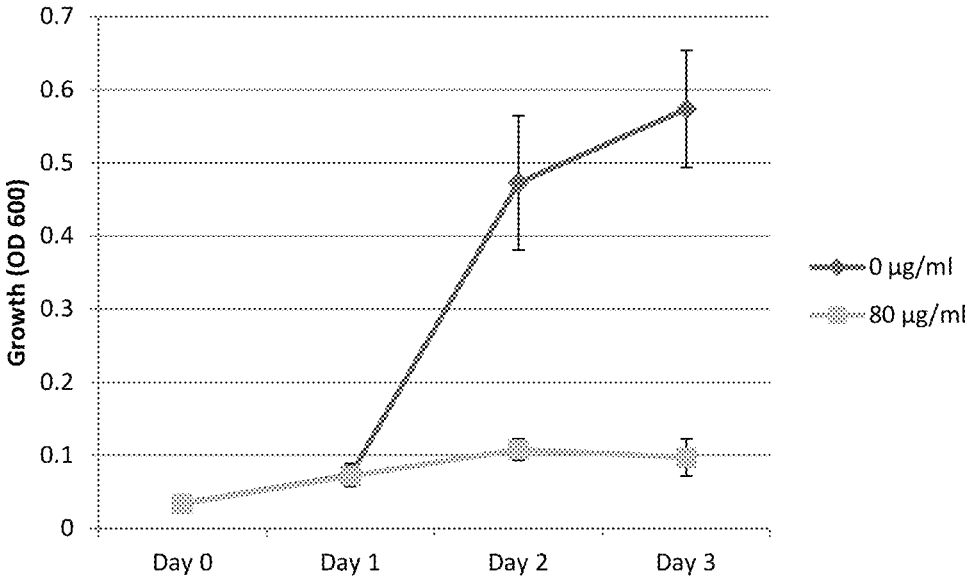

FIG. 12 illustrates results of the 80 μg/mL treatment on initial measured microbial growth in the aqueous phase as well as microbial growth after one, two, and three days. Treatment of the jet fuel significantly decreased microbial growth in the aqueous phase.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method of preventing biodeterioration of a fuel by reducing growth of fuel degrading microbes in the fuel, the method comprising:

selecting a lyophilized antimicrobial peptide and a lyophilized efflux pump inhibitor, the lyophilized antimicrobial peptide and efflux pump inhibitor configured to disrupt the cellular membrane of the fuel degrading microbes comprising the growth and the lyophilized antimicrobial peptide has a β-sheet conformation, an α-helix conformation, or both;

administering the lyophilized antimicrobial peptide in an amphipathic solvent and the lyophilized efflux pump inhibitor in the amphipathic solvent to a fuel phase of the fuel such that a concentration of the lyophilized antimicrobial peptide in the fuel phase ranged from 1 ppm to 100 ppm and a concentration of the lyophilized efflux pump inhibitor ranges from 20 ppm to 80 ppm, wherein administering the lyophilized antimicrobial peptide and efflux pump inhibitor reduces a visual size of the growth by about 85%, reduces a measured cell density to less than about $1\times10^3$ cell/mL, or both.

2. The method of claim 1, wherein the antimicrobial peptide is selected from the group consisting of Protegrin-1, Magainin-2, Retrocyclin-101, PR-39, combinations thereof, and analogs thereof.

3. The method of claim 1, wherein the efflux pump inhibitor is selected from the group consisting of:

a peptidomimetic;

a c-capped dipeptide;

a dipeptide compound;

Phe-Arg-β-napthylamide and analogs thereof;

a diamine-containing peptide and analogs thereof;

a compound configured to competitively bind to a biding site of the efflux pump, wherein the efflux pump is of the resistance nodulation division family;

a compound configured to competitively bind to a binding site of the efflux pump, wherein the efflux pump is of the major facilitator superfamily;

a compound configured to competitively bind to a binding site of the efflux pump, wherein the efflux pump is of the ATP-binding cassette superfamily;

an allosteric inhibitor of the efflux pump;

a pyridopyrimidine;

an arylpiperazine;

an arylpiperidine;

antibodies or nanobodies configured to bind to an epitope of the efflux pump;

a nucleic acid;

an aptamer;

a small chemical molecule having a structure configured to recognize, interact, and block the efflux pump; and peptides having secondary, tertiary, or quaternary structure that is configured to bind and block efflux pumps or porins within the cellular membranes.

4. The method of claim 1, wherein the amphipathic solvent is diethylene glycol monomethyl ether, absolute ethanol, or an anhydrous alcohol.

5. The method of claim 1, further comprising:

determining a fuel-to-water partition coefficient for each of the lyophilized antimicrobial peptide and efflux pump inhibitor.

* * * * *